United States Patent [19]

Burgwin

[11] Patent Number: 4,684,047

[45] Date of Patent: Aug. 4, 1987

[54] BELT-MOUNTED BOW AND ARROW SUPPORT DEVICE AND METHOD

[76] Inventor: Michael Burgwin, 408 Stolp Ave., Syracuse, N.Y. 13207

[21] Appl. No.: 925,740

[22] Filed: Oct. 31, 1986

[51] Int. Cl.[4] ..... A45F 5/00

[52] U.S. Cl. ..... 224/253; 224/248; 224/916

[58] Field of Search ..... 224/916, 248, 252, 257, 224/242, 270, 268; 124/88

[56] References Cited

U.S. PATENT DOCUMENTS

| | | | |
|---|---|---|---|
| 475,640 | 5/1892 | Unger | 224/270 |
| 3,168,971 | 2/1965 | Goertzen | 224/916 X |
| 3,191,827 | 6/1965 | Tofte, Jr. | 224/248 X |
| 3,232,501 | 2/1966 | Merenda | 224/916 X |
| 3,450,317 | 6/1969 | Ramer | 224/242 |
| 3,963,156 | 6/1976 | Perrin | 224/268 |
| 4,103,807 | 8/1978 | Lyon et al. | 224/916 X |
| 4,121,743 | 10/1978 | Burton | 124/88 X |
| 4,621,752 | 11/1986 | Youngbauer | 224/916 X |

*Primary Examiner*—Stephen Marcus
*Assistant Examiner*—Robert M. Petrik
*Attorney, Agent, or Firm*—Charles S. McGuire

[57] ABSTRACT

The present invention concerns a support for an archery bow which also permits an arrow to be carried with its notched end engaged with the bow string. The support includes a loop for attachment to the archer's wearing apparel and is preferably fabricated from a single strand of wire bent to a configuration including means for engagement thereof with the archer's belt, and a pair of spaced, V-shaped portions upon which the bow string rests. Centrally disposed between the V-shaped portions are a pair of spaced, parallel members between which the notched end of the arrow is positioned, in frictional engagement with the bow string and suspended downwardly therefrom.

10 Claims, 4 Drawing Figures

BELT-MOUNTED BOW AND ARROW SUPPORT DEVICE AND METHOD

BACKGROUND OF THE INVENTION

The present invention relates to devices for support of a bow and arrow, and more specifically to a device for engagement with the archer's belt or other wearing apparel in a manner allowing a bow to be supported with an arrow engaged with the bow string, and to a method of so supporting a bow and arrow.

An example of a prior art device suspended from a belt for attachment of the handle of a bow to permit support and transport thereof while leaving the wearer's hands free is found in U.S. Pat. No. 4,121,743. The belt-mounted portion has a slotted member attached thereto, and a separate piece is affixed to the bow handle for sliding engagement with the slotted member. Belt-mounted gun carriers are disclosed in U.S. Pat. Nos. 3,022,156, and 3,963,156, and devices formed of wire for carrying hammers or other such tools suspended from the belt are described in U.S. Pat. Nos. 1,326,887 and 3,104,434.

It is a principal object of the present invention to provide a novel and improved device for supporting a bow suspended from the archer's belt or other wearing apparel which permits an arrow also to be carried in the "nocked" position, i.e., with its slotted end engaged with the bow string, ready for immediate use.

A further object is to provide a simple and inexpensive device for supporting a bow and arrow, requiring no attachment of any structure to, or other modification of, the basic bow and arrow structure.

Another object is to provide a novel method of supporting a bow and arrow by a device suspended from the belt or other portion of the archer's wearing apparel.

Other objects will in part be obvious and will in part appear hereinafter.

SUMMARY OF THE INVENTION

In accordance with the foregoing objects, the present invention comprises a device which may be fabricated from a single strand of stiff wire, or the like, bent to a configuration which includes a loop or hook portion for engagement with a belt worn by the archer, or having other means for attachment to the archer's wearing apparel. The device further includes a pair of arms extending outwardly from the loop or other attachment portion, and thence upwardly to provide two, spaced, essentially V-shaped portions. The wire extends inwardly from the upper end of each V-shaped portion, and thence downwardly and rearwardly to provide two, spaced, substantailly parallel portions inwardly of the V-shaped portions.

The bow is suspended from the device simply by placing the bow string in the upwardly-disposed apex of the spaced, V-shaped portions with the bow handle suspended downwardly from the supported string. An arrow is placed with its notched end in engagement with the bow string between the two, spaced, parallel portions of the device, and hangs with its pointed end downward.

DETAILED DESCRIPTION

Figure 1:
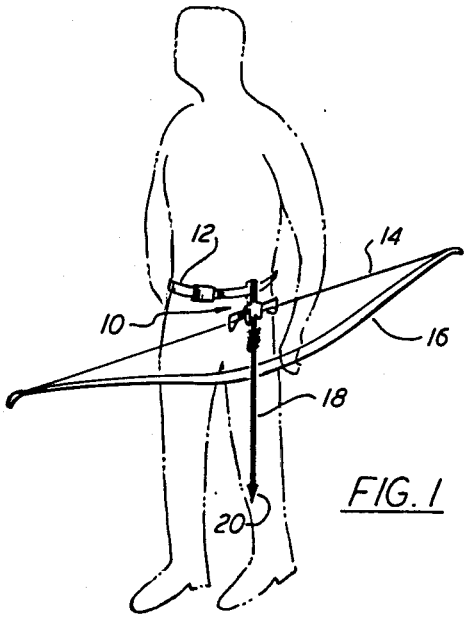
FIG. 1 is a perspective view, showing an archer in phantom lines wearing the support device with a bow and arrow suspended therefrom according to the present invention.
Figure 2:
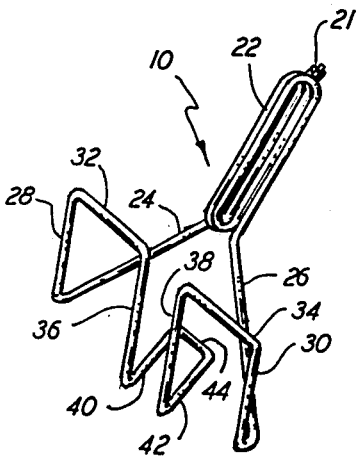
FIG. 2 is a perspective view of the support device.

Referring now to the drawing, the support device of the invention, denoted generally by reference numeral 10, is shown in FIG. 1 mounted upon belt 12 of an archer. Bow string 14 is placed upon portions of device 10, as described hereinafter, and handle 16 hangs downwardly therefrom. Arrow 18 is in the nocked position, that is, the notched end of the arrow is engaged with bow string 14 in the usual manner, and hangs with arrow head 20 pointing downward.

Device 10 is preferably fabricated from a single length of stiff wire which may be provided in conventional manner with a rubber or plastic coating. The two ends of the wire are twisted together at 21 in the finished form of device 10, in the disclosed embodiment. The wire extends from the terminal ends in adjacent relation to itself, being bent in elongated, open loop portion 22, thereby providing means by which device 10 may be suspended from belt 12. From loop 22 the wire extends downwardly and outwardly at about 45 degree angles on each side to provide legs 24 and 26. From each leg the wire is bent generally upwardly, providing upright segments 28 and 30 which, together with legs 24 and 26, form substantially V-shaped portions.

Figure 3:
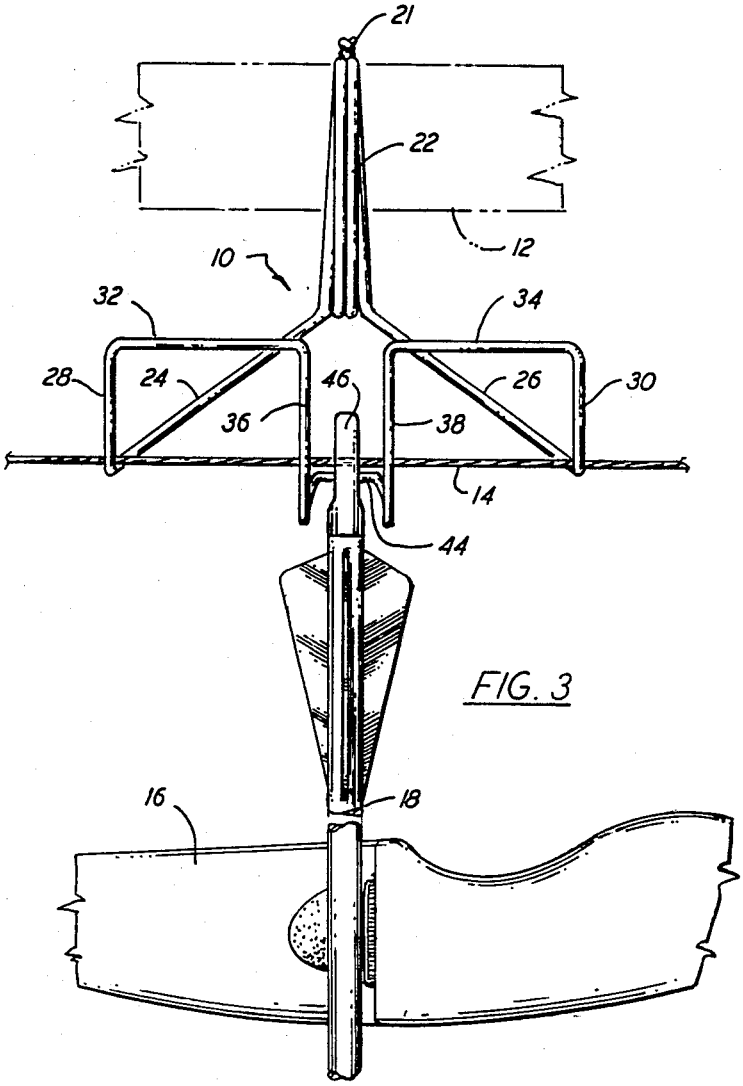
FIG. 3 is a front elevational view of the device, showing portions of the bow and arrow carried thereby and a fragment of the archer's belt in phantom lines.
Figure 4:
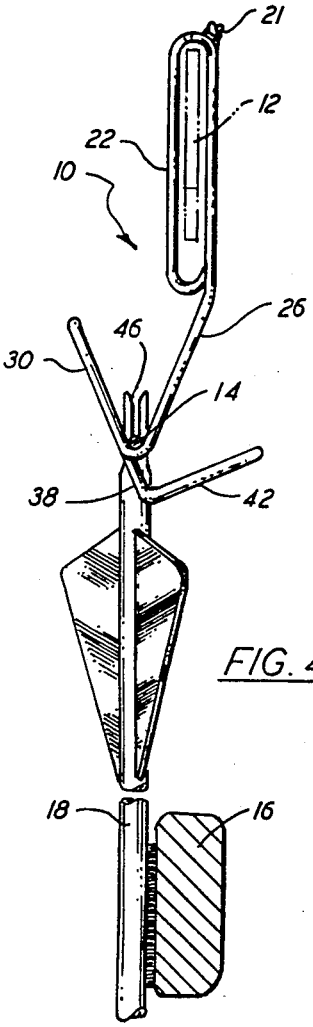
FIG. 4 is a side elevational view of the elements shown in FIG. 3.

From segments 28 and 30 the wire is bent inwardly to provide horizontal segments 32 and 34. The wire is then bent downwardly, providing parallel portions 36 and 38, and thence rearwardly, providing second parallel portions 40 and 42 which are joined by intermediate portion 44. The terms "downwardly," "horizontal," "rearwardly," and the like, are used for convenience to denote directions and positions which are present when device 10 is mounted upon an archer's belt in the illustrated manner, and not in an otherwise limiting sense. The position of device 10 may be clearly seen in FIGS. 3 and 4, where it is shown with belt 12 extending through loop 22.

When device 10 is so mounted, the archer may position the bow with handle 16 downward and place string 14 in the upwardly facing apices of the V-shaped portions formed by leg 24 and segment 28, and leg 26 and segment 30. Notched end 46 of arrow 18 is placed in engagement in the usual manner with bow string 14 at its center, which may be performed either before or after the bow is placed upon device 10. The portion of arrow 18 adjacent notched end 46 is then positioned between parallel portions 36 and 38, and possibly between some of portions 40 and 42, depending upon the exact orientation of device 10, as may be seen from FIGS. 3 and 4. The frictional engagement of notched end 46 of arrow 18 with string 14 is sufficient to maintain such engagement and prevent the arrow from falling off with most conventional arrows and the bow strings with which they are used.

Although a number of modifications may be made in the configuration of device 10 within the scope of the invention, it is preferred that a single piece of wire be used in the fabrication. The continuity of the wire and the adjacent relationship of the terminal ends of the wire and the portions thereof forming loop 22 contributes to the rigidity and stability of the device. Means for attaching device 10 to the archer's wearing apparel, other than loop 22 for passage of a belt, may be employed. For example, one or more portions may be bent over in the nature of hooks or clips for placing over the waistband of trousers, or a pin may be provided for piercing the clothing, in the event a belt is not worn. In any event, the device is attached to the archer's wearing apparel at or near the waistline.

What is claimed is:

1. A device for attachment to an archer's wearing apparel for carrying a bow with an arrow engaged with the bow string, said device comprising:

(a) a portion adapted for connecting said device to a portion of the archer's wearing apparel at the waist;

(b) a pair of members extending from said connecting portion to form a pair of spaced, V-shaped portions opening upwardly;

(c) a pair of parallel members integrally connected to said V-shaped portions and centrally disposed therebetween in spaced relation, whereby a bow may be carried by placing the bow string upon said V-shaped members with the notched end of an arrow engaged with said bow string between said parallel members to suspend said arrow downwardly from said bow string across the bow handle.

2. The invention according tro claim 1 wherein said device is fabricated from a single length of rigid wire bent to the recited configuration.

3. The invention according to claim 2 wherein the terminal ends of said wire are closely adjacent one another.

4. The invention according to claim 3 wherein said wire extends from said ends in closely adjacent relation to itself to from a closed loop providing said connecting portion in a configuration for passage therethrough of the archer's belt.

5. The invention according to claim 4 wherein said wire diverges outwardly and downwardly form said loop, and thence upwardly, to form said V-shaped portions.

6. The invention according to claim 5 wherein said wire extends inwardly from the upper ends of said V-shaped portions and thence downwardly, to form said parallel members.

7. A method of supporting a bow and arrow comprising:

(a) attaching to the archer's wearing apparel at the waistline a device having a pair of laterally spaced, V-shaped portions with the open ends thereof facing upwardly when so attached;

(b) frictionally engaging the notched end of an arrow with the bow string substantially centrally thereof; and (c) placing said bow string upon said V-shaped portions with said notched end positioned therebetween and the bow handle and arrow suspended downwardly from the bow string, whereby said bow is supported by said device with said arrow engaged with the bow string for carrying by the archer.

8. the method according to claim 7 and further comprising positioning a pair of parallel, substantially vertically disposed members in spaced relation to one another between said V-shaped portions, and positioning said notched end of said arrow between said members.

9. The method according to claim 8 wherein said device is formed with a closed loop, and said attaching step is performed by passing the archer's belt through said loop.

10. The method according to claim 9 and comprising the initial step of bending a single length of rigid wire to a configuration providing said V-shaped portions, said parallel members and said loop.

* * * * *